US006247248B1

(12) United States Patent
Clark

(10) Patent No.: US 6,247,248 B1
(45) **Date of Patent: *Jun. 19, 2001**

(54) VENTILATION SYSTEM AND METHOD FOR FOOTWEAR

(75) Inventor: Gregory Clark, Weston, CT (US)

(73) Assignee: Breeze Technology, Las Vegas, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/333,034

(22) Filed: Jun. 15, 1999

Related U.S. Application Data

(60) Provisional application No. 60/089,321, filed on Jun. 15, 1998.

(51) Int. Cl.[7] ..... A43B 7/06; A43B 21/26; A43B 13/20

(52) U.S. Cl. ..... 36/3 B; 36/3 R; 36/3 A; 36/35 B; 36/29

(58) Field of Search ..... 36/3 B, 3 R, 3 A, 36/29, 35 B, 27, 28

(56) References Cited

U.S. PATENT DOCUMENTS

| | | | | |
|---|---|---|---|---|
| 2,329,573 | * | 9/1943 | Ziegliss | 36/3 B |
| 3,180,039 | * | 4/1965 | Burns, Jr. | 36/3 B |
| 4,546,555 | * | 10/1985 | Spademan | 36/28 |
| 5,341,581 | * | 8/1994 | Huang | 36/3 B |
| 5,515,622 | * | 5/1996 | Lee | 36/3 R |
| 5,697,170 | * | 12/1997 | Murrell et al. | 36/3 B |
| 5,697,171 | * | 12/1997 | Phillips | 36/3 B |
| 5,809,665 | * | 9/1998 | Suenaga | 36/3 B |
| 5,813,140 | * | 9/1998 | Obeid | 36/3 R |
| 6,044,577 | * | 4/2000 | Clark | 36/3 B |
| 6,079,123 | * | 6/2000 | Clark | 36/3 B |

FOREIGN PATENT DOCUMENTS

| | | | | |
|---|---|---|---|---|
| 2670369 | * | 6/1992 | (FR) | 36/3 B |
| 2262024 | * | 6/1993 | (GB) | 36/3 B |
| 53447 | * | 5/1967 | (PL) | 36/3 R |

* cited by examiner

*Primary Examiner*—Paul T. Sewell
*Assistant Examiner*—Anthony Stashick
(74) *Attorney, Agent, or Firm*—Shaw Pittman

(57) ABSTRACT

A footwear ventilation system that introduces fresh air into a shoe upper using an air displacement chamber actuated by the downward force of a foot. The ventilation system comprises a lasting board and a ventilation unit comprising a one-way inflow check valve, an air displacement chamber positioned in the heel area, a set of non-pinching tubular channels connecting the inflow valve to the displacement chamber, and a one-way outflow check valve that expels air from the displacement chamber to the atmosphere. The lasting board is placed on top of the ventilation unit to evenly distribute the deceleration force produced by the ventilation unit. As a shoe contacts the ground under the user's weight, the foot compresses the displacement chamber, forcing air out of the outflow valve and into the atmosphere. When the foot and shoe are lifted off of the ground, the displacement chamber expands and draws a vacuum that pulls the hot, humid air from the shoe upper into the displacement chamber and in turn, draws fresh outside air into the shoe upper. The ventilation unit and lasting board function like a bellows pump to move air through the shoe.

14 Claims, 4 Drawing Sheets

VENTILATION SYSTEM AND METHOD FOR FOOTWEAR

The present application claims priority from the filing date of provisional patent application Ser. No. 60/089,321 filed Jun. 15, 1998, entitled "Ventilation System and Method for Footwear".

BACKGROUND

1. Field of the Invention

This invention relates to ventilated footwear, and in particular, to a footwear ventilation system that uses a foot-actuated compressible air displacement chamber to draw fresh air into the shoe and to discharge hot and humid air out.

2. Background of the Invention

In addition to support and cushioning, a significant aspect of footwear comfort is the ability to dissipate heat and moisture. Excessive heat and perspiration in footwear can lead to comfort problems including malodor, blisters, and fungal growth. Unfortunately, manufacturers have favored designs improving lateral support, cushioning, and durability at the expense of heat dissipation. Specifically, materials added to enhance support and cushioning have increased the insulation surrounding the foot and the resultant trapped heat and moisture. In addition, cosmetic features on footwear have added layers of material that further exacerbate the heat dissipation problem. To alleviate this problem, users have turned to specialized socks that wick moisture away from the foot, deodorizing and disinfecting foot and shoe sprays, and deodorizing insoles. However, these incomplete solutions focus on the symptoms of the problem instead of removing the source.

Footwear ventilation systems known in the prior art have attempted to address the heat dissipation problem by removing excessive heat and moisture with a constant air exchange. However, in all cases, the ventilation systems reduce the cushioning capacity of other shoe components (e.g., the midsole), fail to move enough air to be effective, or are too complex to easily and inexpensively manufacture. The conventional system uses a collapsible chamber that is actuated by the cyclic downward force of the user's foot. The chamber is built into the midsole of the shoe and requires the removal of a significant portion of the midsole cushioning material. In addition, the typical ventilation systems incorporate at least two check or one-way valves: an inlet valve that only permits air to flow into the chamber, and an exhaust valve that only permits air to flow out. Typically, these valves are also contained in the midsole, further displacing cushioning material. Prior art designs have installed the air displacement chamber in a variety of midsole locations: in the heel, U.S. Pat. Nos. 1,660,698, 5,010,661, 5,606,806, and 5,697,171; in the forefoot U.S. Pat. No. 5,697,170; under the arch, U.S. Pat. No. 3,284,930; and extending the full length of the foot bed U.S. Pat. No. 4,602,441. In each case, the reduced midsole material detracts from the stability and support of the shoe.

U.S. Pat. Nos. 2,604,707 and 4,776,110 disclose designs in which the pumping chamber is located in a removable insole.

Some footwear ventilation systems in the prior art preserve marginal support and stability while providing adequate ventilation. However, in achieving this combination of cooling and cushioning, they suffer from increased complexity and cost of manufacture. U.S. Pat. No. 5,697,170 discloses a sole with multiple chambers filled with open cell foam. U.S. Pat. No. 5,655,314 discloses a network of channels through the cushioning material that collapse under the load. A bladder surrounding a central cushion is disclosed in U.S. Pat. No. 5,333,397. A central air chamber surrounded with cushioning is disclosed in U.S. Pat. Nos. 5,515,622 and 5,341,581. In most designs, the cushioning and re-inflation are the result of the properties of complicated peripheral cushioning material. U.S. Pat. Nos. 5,697,161 and 5,068,981 utilize springs within the air chamber. U.S. Pat. No. 5,655,314 incorporates cushioning into the air space in the form of domes or ribs. Thus, in each case, meeting the objectives of stability and cooling require a complicated and costly shoe design.

Thus, there remains a need for a low-cost, easily manufactured footwear ventilation system that provides efficient cooling and cushioning. The ventilation system must not compromise the flexibility and cushioning characteristics of the midsole, and optimally should use the ventilation system components (such as an air displacement chamber) to enhance cushioning. In improving cushioning, the ventilation system should provide a controlled deceleration of the shoe cushion, allowing a user to adjust the cushioning characteristics to her personal preference. Finally, the ventilation system should be modular and easily adapted to a variety of footwear designs.

SUMMARY OF THE INVENTION

The present invention is an active footwear ventilation system that cools the foot, reduces sweat, and provides cushioning superior to the ventilated footwear designs known in the prior art. The ventilation system removes significant heat and humidity from footwear, affording users with considerable additional comfort. Further, the ventilation system design is uncomplicated and easy and cost effective to produce.

The ventilation system, also referred to herein as an air pumping system, comprises an inflow valve, tubular channels, a resilient air displacement chamber (hereinafter referred to as "displacement chamber"), an outflow valve, and a lasting board. The inflow valve resides in the forefront of the shoe and draws in air from the shoe upper. The inflow valve is connected to the displacement chamber by the tubular channels. The displacement chamber is connected to the outflow valve, which resides at the outside mid-foot region of the shoe and discharges air to atmosphere.

The displacement chamber is wedge shaped when viewed from the profile perspective of a shoe, with the maximum thickness of the displacement chamber at the rear of the shoe and the minimum thickness at a point under the arch at which it connects to the tubular channel compartment. The displacement chamber rests between the midsole and upper of a shoe. The lasting board is positioned on top of the displacement chamber, inside the upper, to evenly distribute the downward force of the foot over the entire surface area of the displacement chamber.

The ventilation system operates as follows. As the shoe heel strikes the ground, the force of the foot compresses the displacement chamber, expelling all of the air contained in the displacement chamber through the outflow valve. As the shoe comes off the ground, the downward force of the foot ceases and the displacement chamber expands. This expansion creates a vacuum that pulls the hot, humid air from the shoe upper in through the inflow valve and draws cool, fresh outside air into the shoe upper. The hot, humid air flows from the inflow valve, through the tubular channels, and occupies the fully expanded displacement chamber. This process repeats with each stride providing a continuing flow of cool, fresh air into the shoe upper.

The user controls the airflow through the ventilation system with the high performance inflow and outflow valves. The inflow valve is adjustable to regulate the rate of airflow through the system. The outflow valve is a shut-off valve that activates or deactivates the ventilation system to suit climatic conditions and user preference. In the preferred embodiment of the present invention, the outflow valve is placed on the outside mid-foot region of the shoe to maximize durability and reliability. In this location, the outflow valve is subjected to the least amount of flexing, torquing, and compression. Also in the preferred embodiment, the inflow valve is rigidly constructed to prevent crushing under the forefoot and includes particle filter barriers to keep the ventilation system clean and the airflow unobstructed.

To increase airflow pumping efficiency, in the preferred embodiment of the present invention, the displacement chamber is constructed of a blow-molded part with angular sidewalls that easily flatten. As a result of the blow-molding process, fillets are preferably formed on the internals corners of the displacement chamber to give the chamber an enhanced memory to return to its uncompressed form. The displacement chamber is preferably constructed of a material that glues easily to other standard shoe component materials and is resilient, durable, and flexible, e.g., EVA, Santoprene, and high density polyethylene.

Unlike prior art designs that insert air displacement chambers into the midsole, the present invention places the displacement chamber on top of the midsole, preserving the maximum amount of midsole cushioning. In this configuration, the displacement chamber functions like a bellows, allowing for a seamless and smooth transition between expansion and compression. Additionally, when fully compressed, the foot rests on the lasting board and the full thickness of the midsole, instead of on an uncomfortable midsole cavity or cup. Further, using a lasting board and preserving the full thickness of the midsole prevents the sidewalls of the shoe from pinching the foot inward as the displacement chamber deflates and the foot compresses the midsole. Preferably, the lasting board is constructed of a porous, nonwoven fiber that is lightweight and rigid, yet withstands constant torquing. Also, the lasting board allows airflow from the shoe upper into the inflow valve.

In the preferred embodiment of the present invention, the tubular channels that connect the inflow valve to the displacement chamber are rigid enough to resist pinching and remain open when twisted and bent, yet flexible enough to permit a comfortable torquing and bending of the shoe forefoot.

In the preferred embodiment of the present invention, the components of the ventilation system are joined as one modular unit. Thus, for ease of manufacture, the modular unit can be manufactured separately from other shoe components and incorporated into the final shoe assembly. Further, the separate manufacture simplifies testing of the ventilation units for quality control.

Accordingly, an object of the present invention is to provide a footwear system that cools and cushions the foot.

Another object of the present invention is to remove moisture, heat, and humidity from a shoe by ventilating with fresh outside air.

These and other objects of the present invention are described in greater detail in the detailed description of the invention, the appended drawings, and the attached claims.

DETAILED DESCRIPTION OF THE DRAWINGS

Figure 1:
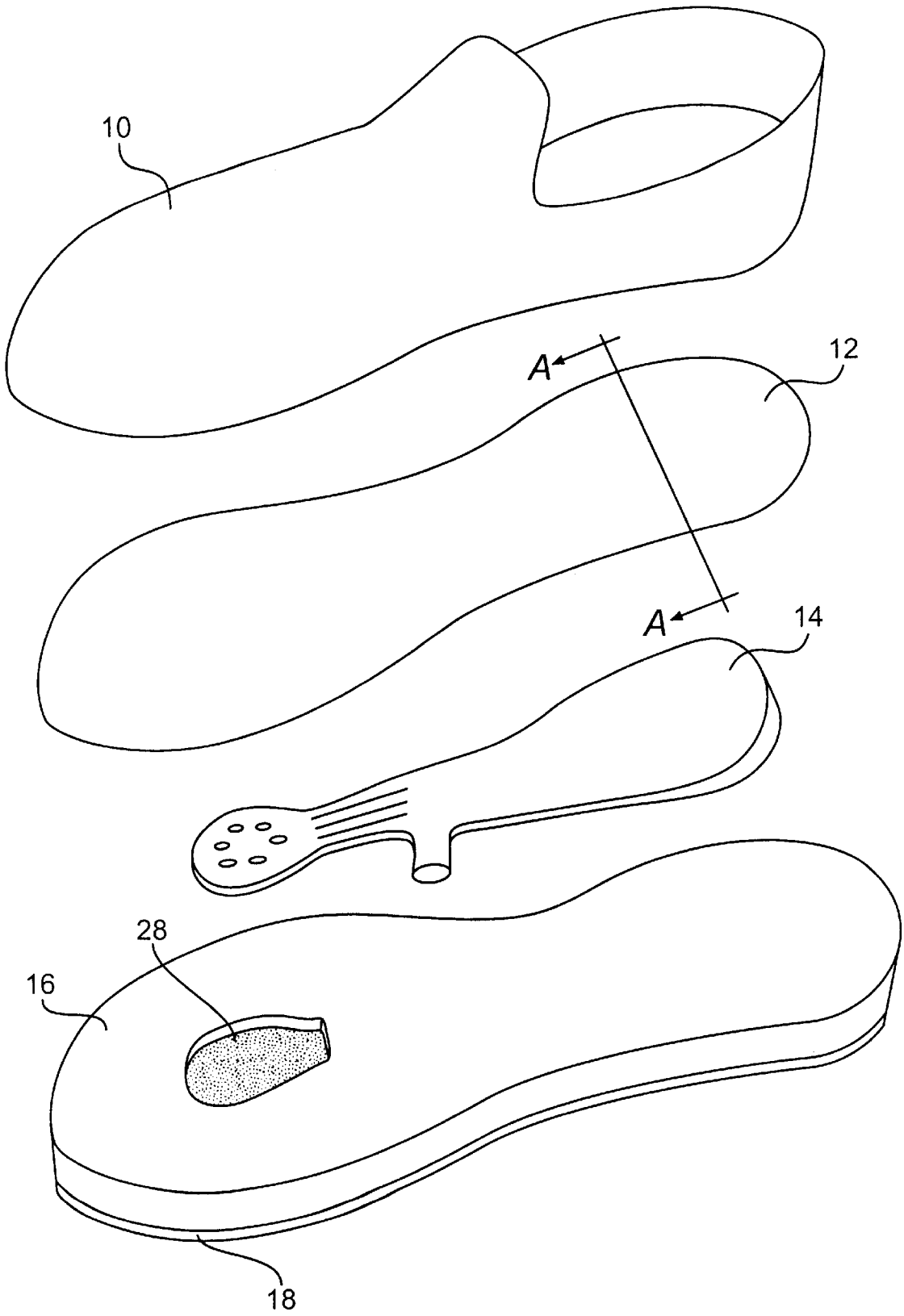
FIG. 1 is a schematic drawing showing an exploded view of a shoe assembly with a ventilation unit.

Referring to the figures, the present invention comprises a lasting board and modular ventilation unit inserted between the upper and midsole of a conventional shoe. FIG. 1 shows an exploded perspective view of the present invention incorporated into a typical shoe comprising an upper 10, a lasting board 12, a ventilation unit 14, a midsole 16, and an outsole 18. Ventilation unit 14 is a wedge shaped air compartment, positioned on midsole 16 with its maximum thickness at the rear of the shoe and its thin front portion positioned over the forefoot of midsole 16. The large flat surfaces of ventilation unit 14 securely bond to the top of midsole 16 and the bottom of lasting board 12.

Figure 2:
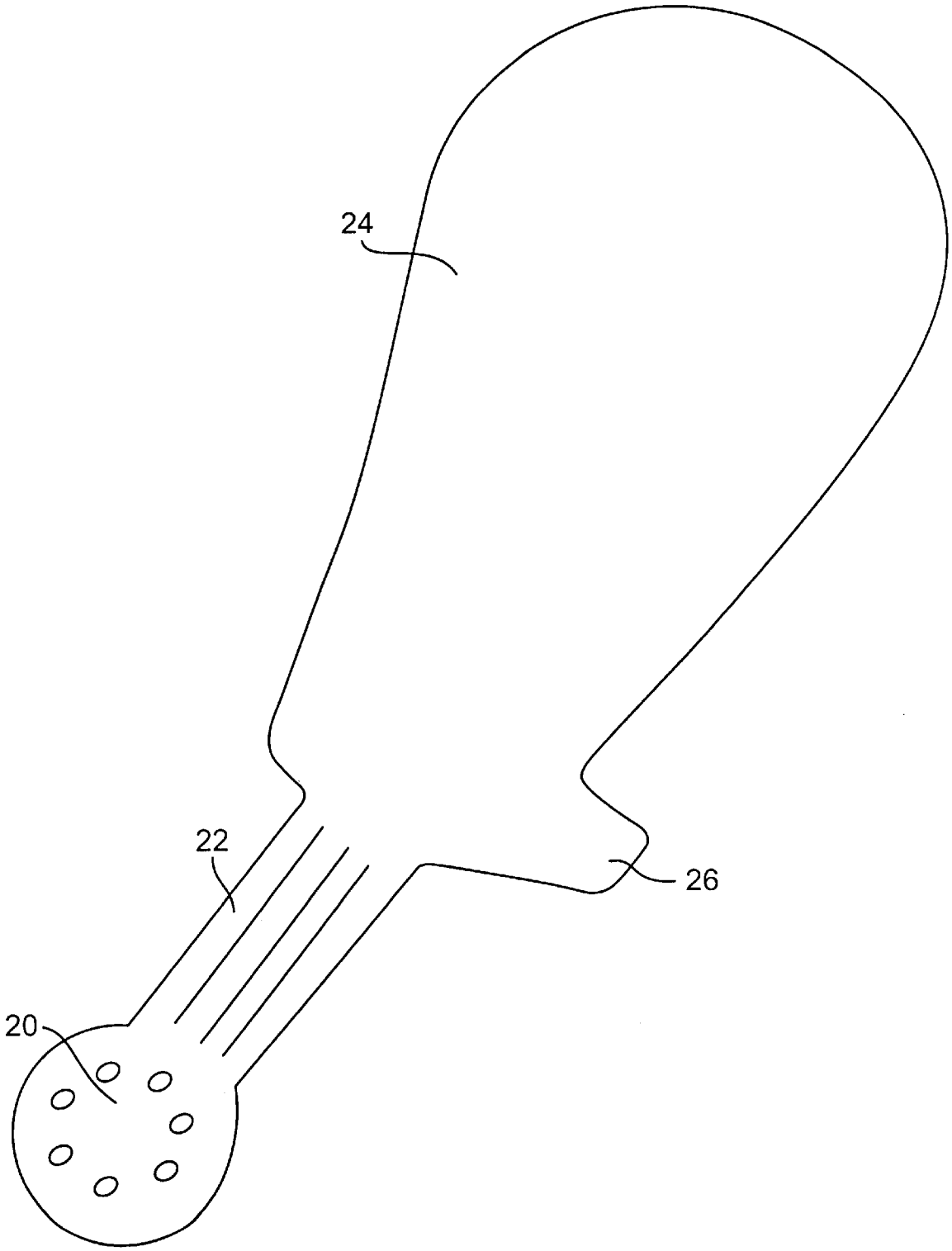
FIG. 2 is top view of the ventilation unit shown in FIG. 1.

As shown in FIG. 2, ventilation unit 14 comprises an inflow valve 20, tubular channels 22, a resilient air displacement chamber 24, and an outflow valve 26. Inflow valve 20 rests on top of the forefoot of midsole 16 and fluidly connects to tubular channels 22. Tubular channels 22, in turn, fluidly connect to displacement chamber 24. Outflow valve 26 is molded to the outside mid-foot region of displacement chamber 24 at which location displacement chamber 24 is of minimum thickness. Joined in this sequence, air through ventilation unit 14 flows into inflow valve 20, through tubular channels 20, inside displacement chamber 24, and out outflow valve 26.

Figure 5:
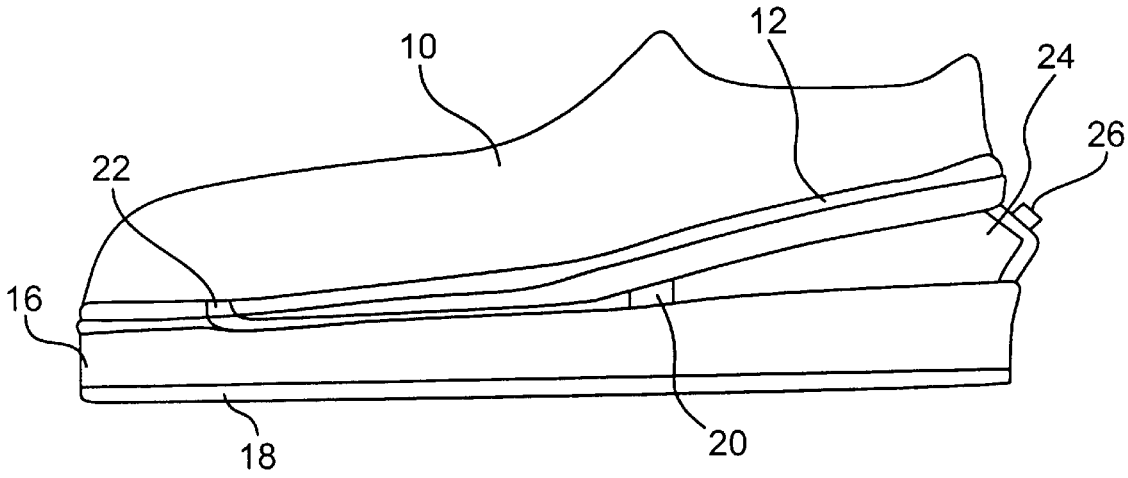
FIG. 5 is a longitudinal cross sectional view of a shoe with an uncompressed ventilation assembly.
Figure 6:
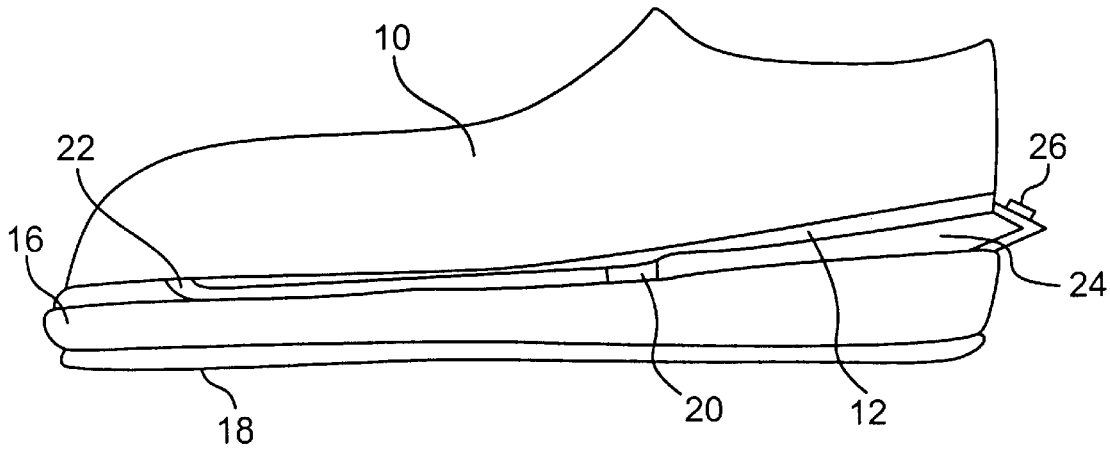
FIG. 6 is a longitudinal cross sectional view of a shoe with a compressed ventilation assembly.

Optionally, the positions of inflow valve 20 and tubular channels 20 could be reversed such that air enters tubular channels 20 at the forefoot of the shoe and flows in through inflow valve 20 and into displacement chamber 24. FIGS. 5 and 6 illustrate this configuration in both an uncompressed and a compressed state, respectively.

A user's motion of walking or running actuates the ventilation system as follows. As the shoe heel strikes the ground, the force of the foot compresses displacement chamber 24, expelling all of the air contained in displacement chamber 24 through outflow valve 26. As the shoe is lifted off of the ground, the foot lifts off of displacement chamber 24, allowing it to expand. This expansion creates a vacuum that pulls the hot, humid air from upper 10 in through inflow valve 20 and draws cool, fresh outside air into upper 10. The hot, humid air flows from inflow valve 20, through tubular channels 22, and occupies the fully expanded displacement chamber 24. This airflow exchange repeats with each stride providing a continuing flow of cool, fresh air into shoe upper 10.

In the preferred embodiment, ventilation unit 14 incorporates at least two check valves, shown in FIG. 2 as inflow valve 20 and outflow valve 26, that regulate air into and out of ventilation unit 14. Preferably, inflow valve 20 only allows passage of air into ventilation unit 14, while outflow valve 26 allows only passage of air out of ventilation unit 14. Also, preferably inflow valve 20 is an adjustable valve that permits a user to regulate the rate of airflow through ventilation unit 14 and outflow valve 26 is a shut-off valve that permits a user to activate or deactivate the ventilation system. Arranged in this configuration, the valves draw fresh air into upper 10 and expel hot, humid air through ventilation unit 14 and out to atmosphere. However, alternately, the directions of inflow valve 20 and outflow valve 26 can be reversed such that the airflow is reversed. In this alternate configuration, ventilation unit 14 injects fresh air into upper 10, pushing the hot, humid air out.

As shown in FIG. 1, in the preferred embodiment of the present invention, inflow valve 20 is located on the forward lower face of ventilation unit 14, resting on midsole 16 in a slight depression 28. In this position, inflow valve 20 is well protected and does not impact the feel of the footbed. Ideally, a simple removable mechanical filter, e.g., a mesh screen or porous open cell foam, covers inflow valve 20, protects ventilation unit 14 from dirt and grit, and provides an easy means for cleaning or replacement.

Connecting inflow valve 20 to displacement chamber 24, tubular channels 22 are flexible enough to permit torquing and bending of the forefoot, yet rigid enough to prevent pinching and obstructing air flow.

Figure 3:
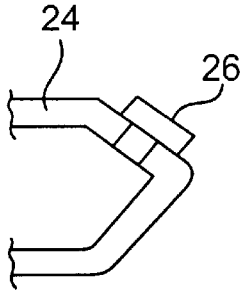
FIG. 3 is a schematic drawing showing the outflow valve affixed to an uncompressed displacement chamber sidewall.
Figure 3A:
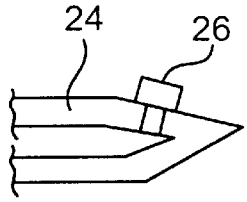
FIG. 3*a* is a schematic drawing showing the outflow valve affixed to a compressed displacement chamber sidewall.

As shown in FIG. 2, outflow valve 26 is preferably located on the outside mid-foot region of the shoe where the least amount of flexing, torquing, and compression occurs. Optionally, another preferred location is on the upper or lower wall of displacement chamber 24 at the rear of displacement chamber 24, as shown in FIGS. 3 and 3*a*. In this location, outflow valve 26 tilts as the sidewalls of displacement chamber 24 fold (as shown in FIG. 3*a*). Thus, outflow valve 26 does not interfere with the cavity compression. FIGS. 5 and 6 also show this outflow valve location in an uncompressed and a compressed state, respectively.

Figure 4:
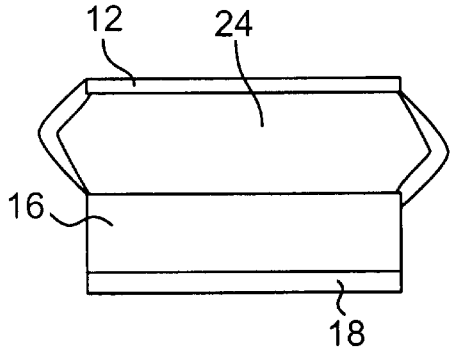
FIG. 4 is a cross sectional view of another embodiment of the shoe assembly (with triangular side peripheral walls) shown in FIG. 1, along the A—A line, with the displacement chamber uncompressed.
Figure 4A:
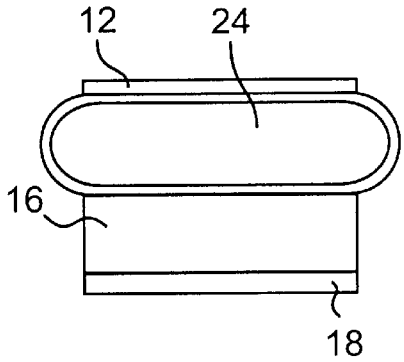
FIG. 4*a* is a cross sectional view of another embodiment of the shoe assembly (with curved side peripheral walls) shown in FIG. 1, along the A—A line, with the displacement chamber uncompressed.

In the preferred embodiment of the present invention, displacement chamber 24 is a wedge shaped chamber that moves air by opening and closing like a bellows pump. Displacement chamber 24 is preferably made of a durable, flexible material that completely compresses under the applied foot pressure, yet returns to its original shape when released. Because the ventilation system only requires displacement chamber 24 to expand when the wearer's foot is lifted, displacement chamber 24 does not support the wearer's weight and does not need to provide a strong recovery force to assume its original shape. Suitable materials include but are not limited to EVA, polyurethane, Santoprene, and high density polyethylene. The interior side and rear walls of displacement chamber 24 are preferably concave, either in a triangular or curvilinear manner. FIG. 4 and 4*a* show the side and rear peripheral walls as a triangular concavity and a curved concavity, respectively.

An adult running shoe needs to pump between 3 and 6 cubic inches of air into the shoe to provide beneficial cooling. In a typical size 10 shoe, to achieve a volume of 3 cubic inches, the displacement chamber of the present invention would be approximately 3.5 inches wide, 6 inches long, and have a maximum interior height of about ⅓ inches.

In another preferred embodiment, the dimensions of displacement chamber 24 are defined in terms of a volume to thickness ratio or a height to thickness ratio. For example, in a preferred embodiment, the ratio of the length to maximum height of displacement chamber 24 is at least 4. Further, in another preferred embodiment, displacement chamber 24 is essentially a quadrilateral with flat upper and lower surfaces, with a wedge shaped cross-section having a length to maximum height ratio of at least 4 and tapering to zero along a maximum included angle of 15°. In yet another preferred embodiment, the maximum included angle at the front of displacement chamber 24 is no more than 20°, more preferably no more than 15°, and most preferably no more than 12°. To assure that sidewall strains remain well within the elastic limit of the material the minimum included angle between planar faces should be at least 90°.

In the preferred embodiment, displacement chamber 24 is a blow-molded part with fillets formed on all internal corners. These fillets give displacement chamber 24 enhanced memory to return to its uncompressed form. The ability of displacement chamber 24 to compress and return quickly to its original shape provides more efficient air pumping.

From the description above, a number of advantages of the present invention are evident:

(a) The ventilation system of the present invention promotes airflow across the top of the foot and down and around the toes. This cooling effect is noticeable as the toes are the only place on the foot where skin touches skin. The continual replacement of air in the shoe upper with each stride removes all of the moisture and humidity. This air exchange not only makes the shoe more comfortable to wear, but prevents blisters and other moisture related health problems of the feet.

During use, the ventilation system decreases the rate at which the inside shoe temperature rises. For example, during a strenuous workout, over a 30-minute period the inside shoe temperature would be up to 6.5° F. lower than that of a conventional shoe. In addition, the inside shoe relative humidity would be up to 10% lower. This reduction in temperature and humidity combine to produce a 24° F. drop in apparent temperature within the shoe, a very noticeable effect for the user.

(b) The ventilation system of the present invention provides a controlled resistance to compression dependent upon the adjustment of inflow valve 20. A user is able to adjust airflow and the resultant cushioning to her personal preference. Further, using ventilation unit 14 in series, i.e., above a traditional cushioning material, assures that the ventilated shoe will provide adequate shock protection and stability without resorting to complicated midsole designs and exotic materials. The present invention provides superior cushioning to either conventional or prior art ventilated shoes. Placing the soft air system in series with the conventional midsole gives a greater effective deceleration distance of the displacement chamber 24 and a corresponding reduction in the maximum g-force.

In addition, placing the lasting board 22 and soft displacement chamber 24 directly under the foot spreads impact forces over a larger area. This configuration yields a soft and cushioned feeling without sacrificing stability or performance.

The design also has a biomechanical advantage over prior art collapsing heels, i.e., the Achilles tendon is not stretched by excessive heel collapse.

(c) The current design is much simpler and easier to manufacture than prior art systems. Displacement chamber 24 and tubular channels 22 can be manufactured in a low cost blow molding operation. Inflow valve 20 and outflow valve 22 can then be fitted directly to displacement chamber 24, providing a single component (ventilation unit 14) that can be inserted into the shoe. Since the air chamber has substantially flat upper and lower faces, it can be securely bonded to the cushioning midsole and the lasting board.

The design and manufacture of upper 10, midsole 16, and outsole 18 are completely unaffected. The top contour of the midsole is modified slightly to match the shape of inflow valve 20. The only change to the shoe assembly process is the insertion of a prefabricated component between the midsole and the lasting board during the lasting step. Otherwise, shoe assembly techniques remain relatively unchanged.

(d) Since displacement chamber 24 is normally deflated when the user's foot is in contact with the ground, the shoe has a "normal" profile in use, i.e., it doesn't look different.

(e) A further advantage of the current design is that the wearer can actuate the pump even while sitting. A simple rocking motion of the foot will drive airflow.

(f) Gradually tapering the wedge shaped displacement chamber to zero thickness in the mid-foot region eliminates pressure points and noticeable changes in footbed stiffness and maximizes user comfort.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims appended hereto, and by their equivalents.

What is claimed is:

1. A footwear ventilation system comprising:

(a) a lasting board; and (b) a ventilation unit comprising:

(i) an inflow valve allowing one-way airflow;

(ii) a displacement chamber of essentially a wedge shape, said displacement chamber compressing when under a force but expanding to the wedge shape when the force is removed;

(iii) a plurality of tubular channels connecting the displacement chamber to the inflow valve; and (iv) an outflow valve connected to the displacement chamber, said outflow valve allowing one-way airflow, wherein the lasting board is placed under a shoe upper and on top of the ventilation unit and the ventilation unit is placed on top of a shoe midsole having a forefoot section and a heel section, and wherein the ventilation unit is placed on the shoe midsole with the inflow valve of the ventilation unit over the forefoot section of the shoe midsole and the displacement chamber of the ventilation unit over the heel section of the shoe midsole.

2. The footwear ventilation system of claim 1, wherein the outflow valve is positioned over an outside mid-foot region of the midsole.

3. The footwear ventilation system of claim 1, wherein the outflow valve is positioned over an outside heel section of the midsole.

4. The footwear ventilation system of claim 1, wherein the one-way airflow of the inflow valve is into the inflow valve and the one-way airflow of the outflow valve is out of the outflow valve.

5. The footwear ventilation system of claim 1, wherein the one-way airflow of the inflow valve is out of the inflow valve and the one-way airflow of the outflow valve is into the outflow valve.

6. The footwear ventilation system of claim 1, wherein the inflow valve is an adjustable valve and the outflow valve is a shut-off valve.

7. The footwear ventilation system of claim 1, wherein the inflow valve is a shut-off valve and the outflow valve is an adjustable valve.

8. The footwear ventilation system of claim 1, wherein the shoe midsole contains a depression to accept the inflow valve.

9. The footwear ventilation system of claim 1, wherein the shoe midsole is essentially flat with no depressions and the ventilation unit rests on top of the midsole.

10. The footwear ventilation system of claim 1, wherein the displacement chamber is made from a material selected from the group consisting of EVA, polyurethane, high density polyethylene, and Santoprene.

11. The footwear ventilation system of claim 1, wherein the displacement chamber is blow-molded with a plurality of fillets along a plurality of the inside corners of the displacement chamber.

12. A footwear ventilation system comprising:

(a) a lasting board; and (b) a ventilation unit comprising:

(i) a plurality of tubular channels;

(ii) an inflow valve connected to the plurality of tubular channels, said inflow valve allowing air to flow only in a direction from the plurality of tubular channels into the inflow valve;

(iii) a displacement chamber of essentially a wedge shape connected to the inflow valve, said displacement chamber compressing when under a force but expanding to the wedge shape when the force is removed; and (iv) an outflow valve connected to the displacement chamber, said outflow valve allowing air to flow only out of the displacement chamber, wherein the lasting board is placed under a shoe upper and on top of the ventilation unit and the ventilation unit is placed on top of a shoe midsole having a forefoot section and a heel section, wherein the ventilation unit is placed on the shoe midsole with the tubular channels of the ventilation unit over the forefoot section of the shoe midsole and the displacement chamber of the ventilation unit over the heel section of the midsole.

13. A ventilated shoe comprising:

(a) an outsole;

(b) a midsole facially adhered to the outsole, said midsole of substantially uniform thickness and without depressions, said midsole having a forefoot section and a heel section, said midsole having a planar face opposite the outsole, and having a sidewall extending perpendicularly from the planar face around an entire perimeter of the midsole;

(c) a ventilation unit resting on top of the midsole within the sidewall;

(d) a lasting board layered on top of the ventilation unit; and (e) an upper enveloping the lasting board and connected to the sidewall, wherein the ventilation unit comprises:

(i) an inflow valve allowing one-way airflow;

(ii) a displacement chamber of essentially a wedge shape, said displacement chamber compressing when under a force but expanding to the wedge shape when the force is removed;

(iii) a plurality of tubular channels connecting the displacement chamber to the inflow valve; and (iv) an outflow valve connected to the displacement chamber, said outflow valve allowing one-way airflow, wherein the ventilation unit is placed on the shoe midsole with the inflow valve of the ventilation unit over the forefoot section of the midsole and the displacement chamber of the ventilation unit over the heel section of the midsole.

14. A method of ventilating and cushioning footwear comprising the steps of:

(a) placing an air displacement chamber between an upper and a midsole of a shoe, wherein the air displacement chamber is essentially wedge shaped and contains an inflow and an outflow valve, wherein the inflow valve draws air in from the upper, wherein the outflow valve expels air out of the displacement chamber, and wherein the midsole is of uniform thickness;

(b) adjusting the inflow and the outflow valve to allow a preferred airflow into and out of the air displacement chamber;

(c) compressing the air displacement chamber; and (d) releasing the air displacement chamber.

* * * * *